United States Patent [19]

Miller

[11] 4,369,792

[45] Jan. 25, 1983

[54] BRASSIERE FOR SUPPORTING PROSTHESIS

[76] Inventor: Margaret Y. Miller, 4603 Westridge Pl., Temple Hills, Md. 20031

[21] Appl. No.: 319,370

[22] Filed: Nov. 10, 1981

[51] Int. Cl.[3] ..... A41C 3/10

[52] U.S. Cl. ..... 128/479

[58] Field of Search ..... 128/479, 480, 425, 478, 128/481

[56] References Cited

U.S. PATENT DOCUMENTS

| | | | |
|---|---|---|---|
| 2,717,602 | 9/1955 | Radler . | |
| 3,173,420 | 3/1965 | Mazzoni . | |
| 3,255,754 | 6/1966 | Brumberger | 2/67 |
| 3,297,035 | 1/1967 | Wright | 128/455 |
| 3,348,241 | 10/1967 | Dodds | 3/36 |
| 3,447,538 | 6/1969 | Keown . | |
| 3,556,106 | 1/1971 | Rosner . | |
| 3,568,681 | 3/1971 | Comollo . | |
| 3,651,522 | 3/1972 | Bernfeld . | |
| 3,701,168 | 10/1972 | Balow . | |
| 3,957,057 | 5/1976 | Farino . | |
| 4,024,866 | 5/1977 | Penrock . | |
| 4,166,471 | 9/1979 | Griffin . | |

*Primary Examiner*—Doris L. Troutman

*Attorney, Agent, or Firm*—Quaintance & Murphy

[57] ABSTRACT

A brassiere for supporting a prosthesis on a woman after she has had breast surgery is cut high in front to cover surgical scars on the woman's chest and low under the woman's arms to avoid sensitive surgical incisions. For comfort and ease in putting on the brassiere, the brassiere fastens in front and has no metal fasteners or other hardware on any interior surface. Moreover, the brassiere includes a prosthesis cover in combination therewith for both preventing contact between the prosthesis and woman's skin and for matching with the skin tone of the woman.

9 Claims, 13 Drawing Figures

BRASSIERE FOR SUPPORTING PROSTHESIS

BACKGROUND OF THE INVENTION

1. Field of the Invention

This invention relates to mastectomy brassieres, and more particularly, this invention relates to mastectomy brassieres designed to support either a single prosthesis or a pair of prostheses with both physical comfort and normal appearance.

2. Prior Art and Technical Considerations

The deficiencies of prior art approaches to this problem are well documented in the patent literature. U.S. Pat. No. 3,701,168 issued Oct. 31, 1972, sets forth some of the deficiencies as follows:

"Every year in the United States more than 50,000 women undergo mastectomy operations for the removal of a breast. It has long been recognized that for the rapid rehabilitation of these women, both physically and mentally, a comfortable, well-fitted, and unobtrusive brassiere including a false breast is a necessity. Nothing retards the rehabilitation of these patients more than the fear of looking and feeling "different".

Unfortunately, prior to the present invention a completely satisfactory mastectomy brassiere has not been available. One widely-used form if mastectomy brassiere in present use is formed of sponge rubber or similar material permanently sewn into the bra, which device is unsatisfactory for a number of reasons, including its inability to conform to the constantly changing position and contour of the wearer's normal breast during movement. Moreover, sponge rubber lacks the necessary weight to give the patient a feeling of balance, which lack of weight balance frequently results in the embarrassing tendency of the false breast to "ride up" on the chest wall, giving a lopsided appearance. In an attempt to overcome the latter problem various means have been devised to pull the insert downwardly and anchor it to the wearer's girdle or the like, but this is not only a nuisance, it causes the brassiere straps to cut into the wearer's shoulders, which is very uncomfortable and painful. Another shortcoming of said conventional mastectomy brassieres formed of sponge rubber or the like is that they are usually permanently sewn into the brassiere, and cannot be withdrawn for washing or airing out, which is necessary to eliminate the odor of perspiration, etc.

In an effort to eliminate some of the problems inherent in prior mastectomy brassieres of the type using a permanent filler of sponge rubber or the like, as hereinabove described, in recent years mastectomy bras have been designed which can be inflated, like a balloon, or which include an insert filled with liquid, which type of insert is intended to conform more closely to the contour and position of the patient's normal breast in various different postures, as well as to eliminate the problem of the insert "riding up". Unfortunately, however, and as might be expected, said inflatable and liquid-filled brassieres sometimes develop a leak, particularly if they are of the common type which is merely pinned into the bra, which can result in an extremely embarrassing situation, as will be appreciated."

U.S. Pat. No. 4,024,876 issued May 24, 1977, defines the problems in more detail as follows:

"In the past, prosthetic breasts were established of lightweight pillow-like cushions filled with fibrous padding material, such as cotton. Such prosthesis were often very obviously artificial looking, were of very questionable effectiveness and have become quite unacceptable by those in need of such devices.

The principal shortcomings to be found in fiber-filled prosthetic breasts of the nature referred to above resides in the fact that they are considerably lighter than a normal breast and fail to provide that balance and distribution of weight which is required to afford the user a natural appearance. Further, such prosthesis are rather rigid, non-fluid, non-ductile or non-plastic in nature and not only fail to settle and distribute their mass in the manner that natural breasts do (under the force of gravity), but fail to flow about and redistribute their mass in a regular and natural appearing manner when women wearing them walk or otherwise move about in the course of day-to-day activities.

As a result of the above and in an effort to establish and provide more natural appearing prosthetic breasts, the art to which this subject matter relates provides prosthetic breasts which are substantially equal in size, weight and shape as the breasts they serve to replace and which are substantially the same as the breasts as regards softness, fluidity, ductility and/or plasticity.

To the above end, the present day prosthetic breast is generally and/or most often characterized by a thin-walled flexibly and somewhat elastic molded plastic, sealed, envelope or vessel in the general form or configuration of the breast it is made to simulate and is filled with that volume of water or other suitable fluid necessary to impart into it the necessary or desired weight and volume or fullness.

While the above practices are quite effective to establish and realistic prosthetic breasts, the prosthesis are most often quite heavy, weighing several pounds and are so fluid, ductile and/or plastic in nature that they are not easily handled.

The upper, inside or rear portion of a wearer's breast is to a substantial extent supported and held up by its joinder to the body or rib cage and a brassiere provides desired under and outside support for the lower, forward and/or outer portion of the breast. Further, the breast is naturally permanently oriented relative to the body or rib cage.

In the case of a prosthetic breast, the prosthesis finds no vertical support and no sure orientation from or by the body of the wearer and is free to drop downwardly and out of desired orientation, but for the brassiere which is provided to hold and support it. Accordingly, a brassiere must provide substantially total support and containment for the typical prosthetic breast whereas in the case of a natural breast, the support and containment it provides is only supplemental to the natural support and orientation afforded by the body.

As a result of the foregoing, while quite natural looking and acting prosthetic breasts are available, great difficulty is experienced in properly and effectively containing and supporting them by means of ordinary brassieres. When using ordinary brassieres to support prosthetic breasts, there is a tendency for the prosthesis to drop and pull the brassiere down, to migrate downwardly and drop from between the brassiere and the body of the wearer and/or to shift laterally and/or to rotate or turn about and out of position and orientation within the brassiere. As a result, such ordinary brassieres cannot be effectively and safely used to support and contain prosthetic breasts.

The above has resulted in the establishment and provision of special prosthetic breast brassieres which, as a general rule, are heavy, or bulky, unfeminine, harness-like structures which are most often uncomfortable to wear and which are so aesthetically unattractive and displeasing as to cause emotional stress to the women who must wear them.

The most common characteristic of the prosthetic breast brassiere provided by the prior art is the provision of a broad, heavy, tightly fitting band which extends about the rib cage of the wearer to occur below the lower breast line and which is such that is will not be shifted and/or rolled downwardly by the weight of a prosthetic breast applied thereto and which is such that a prosthesis breast cannot migrate downwardly, between it and the body of the wearer. The noted band is sought to be made heavy enough and is intended to be drawn taut enough so that it is not excessively subject to rolling and/or gathering up into a thin, stiff, narrow cord-like mass. The noted band characteristically extends across and establishes pressure bearing engagement on the solar plexus of the wearer, which pressure, after a short time, results in considerable discomfort.

The ordinary prosthetic breast brassiere is next characterized by substantially standard or usual laterally spaced, forwardly projecting, rearwardly opening, truncated, substantially conical fabric cups with lower edges fixed to the upper edge of the aforementioned band; by shoulder strap fixed to and extending between the upward rear portions of the cups and rear portion of the band and a substantially flat, vertical rear panel of soft fabric fixed with and overlying the lower rear portions of the cup or cups with which the prosthesis or prostheses are to be related and cooperating with the cup or cups to define pockets appearing at the upper rear portions of the cup or cups and in which the prosthesis is to be deposited.

Basically, or fundamentally, the above noted common prosthetic breast brassiere can be said to be little more than an extra heavy duty, strictly utilitarian piece of equipment which is rugged and durable in use, requires rugged and often difficult physical manipulation and handling and requires a durable body and a rugged attitude or disposition on the part of the wearer, to cope with it.

In use of the above noted common prosthetic brassiere, the garment is engaged on the wearer before the prostheses are related to it. When the brassiere is in position, the wearer must then manually stuff the prostheses into the cups and thereafter seek to properly orient them within the cups, as by use of her fingers. As a result of physical weakness and the like caused by the mastectomy, the above noted task is often extremely difficult or impossible."

Other U.S. Patents which are indicative of the state of the art include Ser. Nos. 2,717,602; 3,173,420; 3,348,241; 3,447,538; 3,568,681; 3,651,522; 3,957,057; and 4,166,471.

None of these patents together or in combination suggest a solution to the problem of providing a satisfactory mastectomy brassiere primarily because the brassieres disclosed in each of these patents are cut too low in front so as not to cover mastectomy incision scars and are not cut low enough in the area under the arms and across the rib cage to avoid a very tender and sensitive incision frequently made in that area to remove cancerous tissue. Moreover, none of these patents recognize the need for having a separate cover for enclosing silicon prostheses in order to prevent direct contact between the prostheses and skin of the wearer should the prostheses ride slightly out of their pockets and to match the color of prostheses to the wearer's skin tone.

SUMMARY OF THE INVENTION

In view of the aforementioned deficiencies in the prior art, it is a feature of the instant invention to provide a new and improved mastectomy brassiere which is configured so as not to irritate areas where surgery has been performed while providing the user with a natural appearance.

In view of the aforementioned feature, the instant invention contemplates a brassiere for supporting a prosthesis which brassiere is cut high across the front to cover the pectorial incisions and relatively low under the arm so as not to irritate lateral incisions.

Moreover, the instant invention contemplates utilizing a separate flesh tone cover for a prosthesis insert for the brassiere which also prevents direct contact between the prosthesis and skin.

In addition, the instant invention contemplates a brassiere which has no metal fastenings on inner surfaces thereof which might touch and irritate the user's skin.

Furthermore, the instant invention contemplates a mastectomy brassiere which incorporates at least one and perhaps all of the aforementioned structures in a brassiere which is sewn together as one piece and fastens in front.

DESCRIPTION OF THE PREFERRED EMBODIMENT

Figure 1:
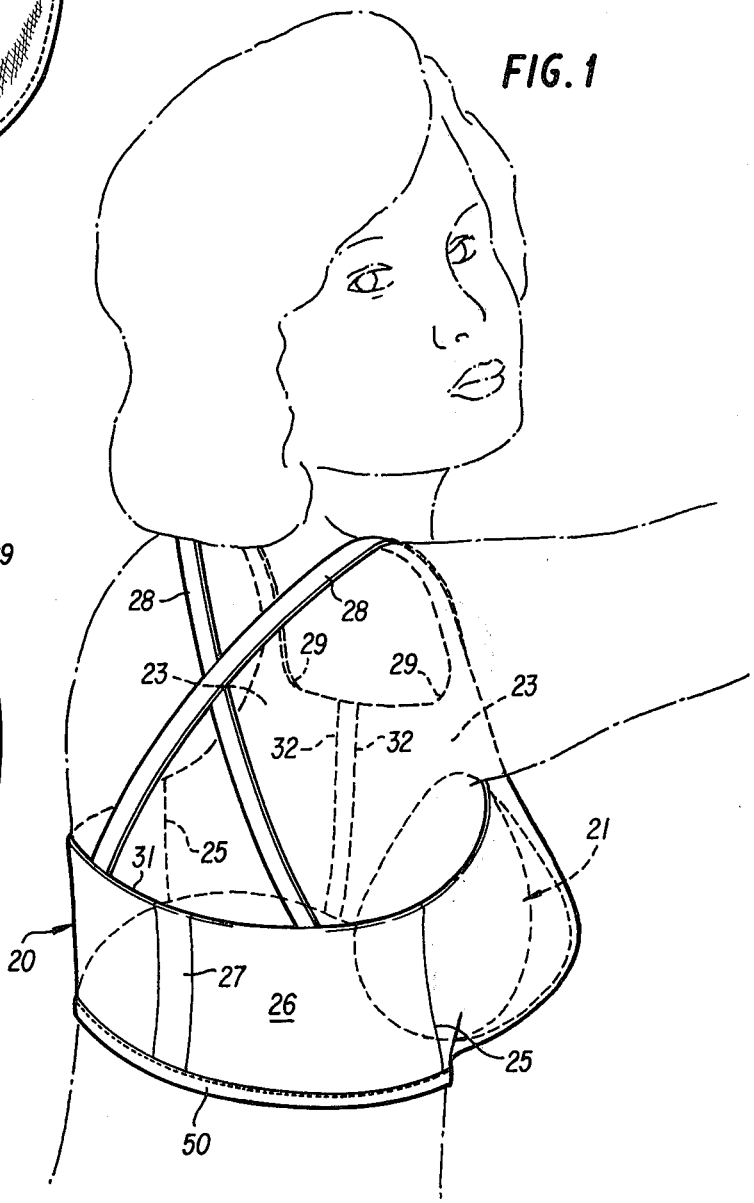
FIG. 1 is a perspective view showing a brassiere in accordance with the instant invention supporting a single prosthesis on a wearer and showing a relatively high-cut front panel for the bra in combination with a relatively low-cut side and rear area.

Referring now to FIGS. 1–7, a mastectomy bra, designated generally by the numeral 20, is used to support a prosthesis, designated generally by the numeral 21. While a single prosthesis 21 is shown in FIG. 1 being supported by the brassiere 20, the brassiere 20 is also designed to support two prostheses if necessary. As is seen in FIGS. 1, 3, 6 and 7, the brassiere 20 generally includes a pair of front panels 23—23 each having a pocket to support a prosthesis 21. At their rear edges 25, each front panel 23 is sewn to a rear panel 26, which rear panel may have a seam 27. A pair of straps 28—28 extend from the top edges 29—29 of the front panels 23—23 to the top edge 31 of the rear panel 27. In accordance with the instant invention, the straps 28—28, front panels 23—23 and rear panel 26 are sewn together to form a unitary or one-piece structure. The only joint in the structure which is separated during use is formed by free, side edges 32—32 of the front panels 23—23, which side edges may be fastened by snaps, a zipper, VELCRO material, or perhaps hooks and eyes. The brassiere 20 needs no other fastening or adjusting structure because all of the elements, with the exception of the pocket area, are made of elastic material. Accordingly, the brassiere will conform to the body of the person wearing the brassiere.

Figure 6:
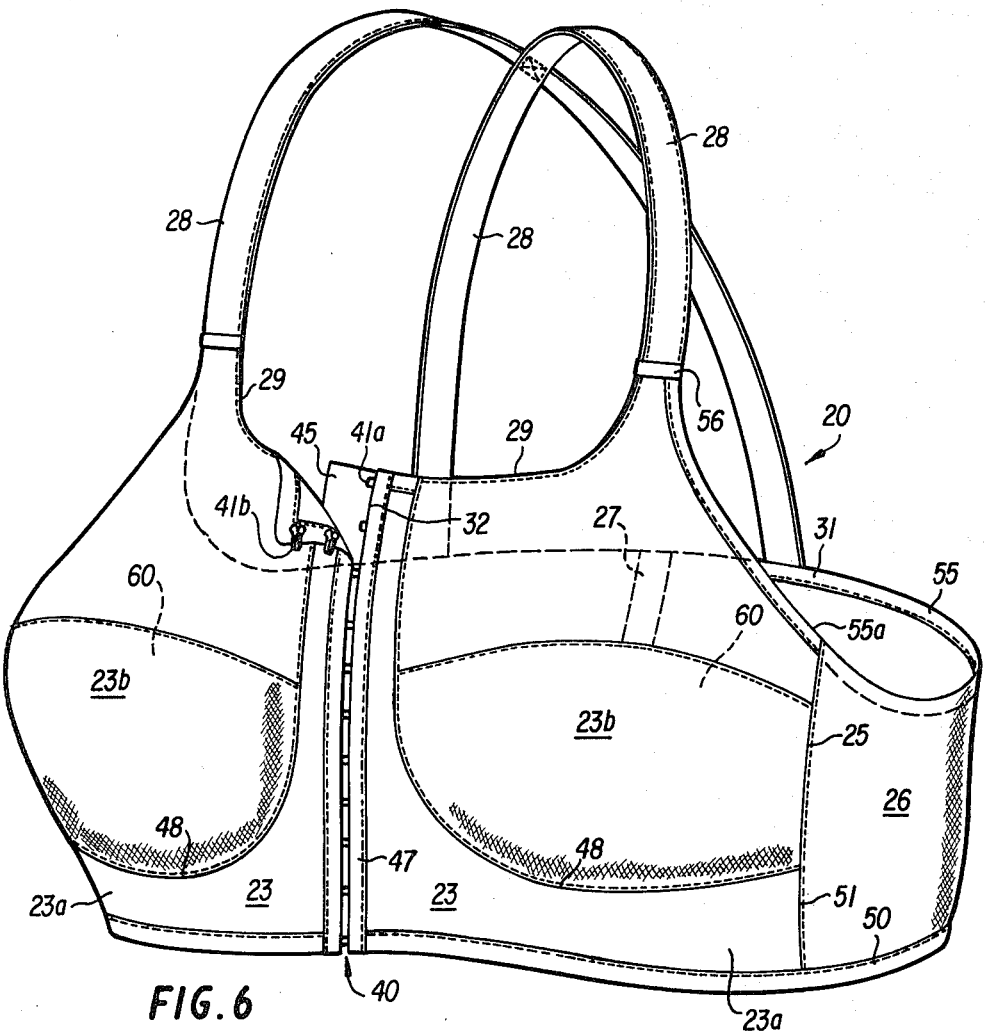
FIG. 6 is a perspective view of the bra of FIG. 1 from the front.
Figure 7:
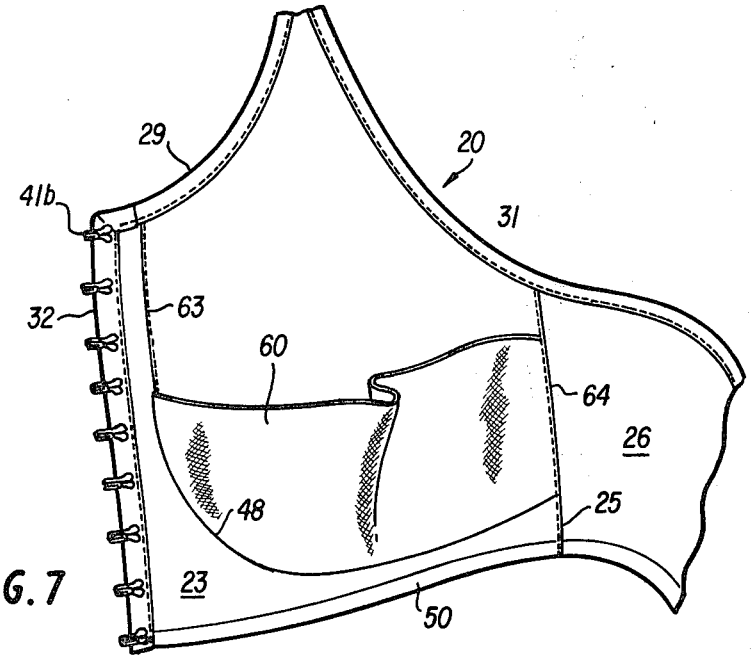
FIG. 7 is a perspective view of a portion of the bra of FIG. 6, looking from the inside toward the front of the brassiere.

As is seen in FIGS. 1, 6 and 7, the top edges 29—29 of the front panels 23—23 are relatively high with respect to the location of the prosthesis 21, while the top edge of the back portion 31 is cut relatively low with respect to the arm of the woman wearing the brassiere. As is readily apparent from FIG. 6, the point at which the top edges 29—29 join the free, side edges 32 is spaced a considerable distance along line 63 from the pocket 60. The edges 29 tend to extend rather straight across the woman's chest instead of plunging to emphasize her cleavage. Accordingly, the incisions relatively high on the woman's chest are covered, while incisions made in the lateral areas under the woman's arms are not covered by or engaged by any part of the brassiere 20. In prior art brassieres, the front edges are too low and frequently cut across incisions while the side and rear edges are too high and also frequently cut across incisions. This causes extreme discomfort and discourages women from wearing mastectomy brassieres.

Figure 3:
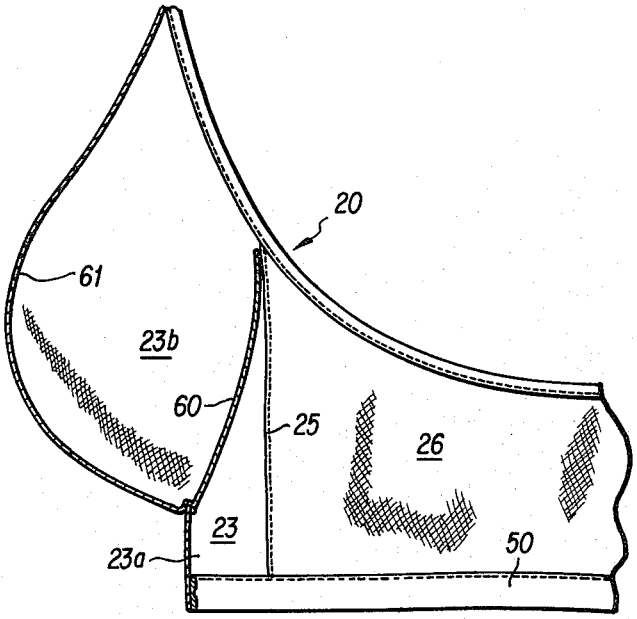
FIG. 3 is a side view, partially in section, of a portion of the brassiere of FIG. 1.
Figure 8:
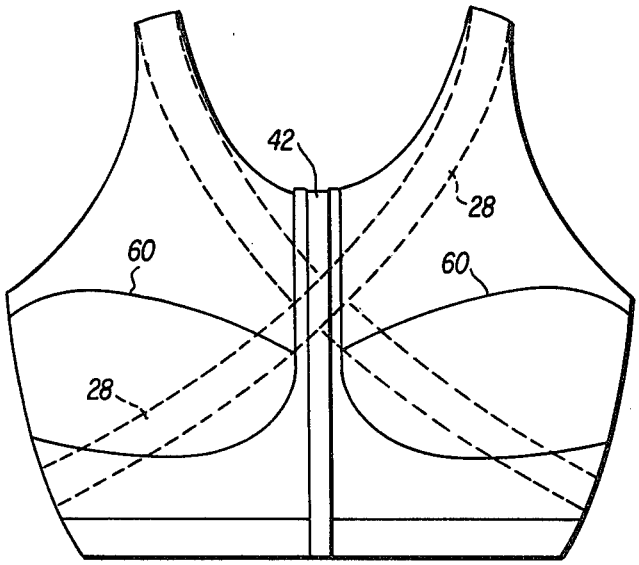
FIG. 8 is a front view of another embodiment of the brassiere utilizing a VELCRO fastener.
Figure 9:
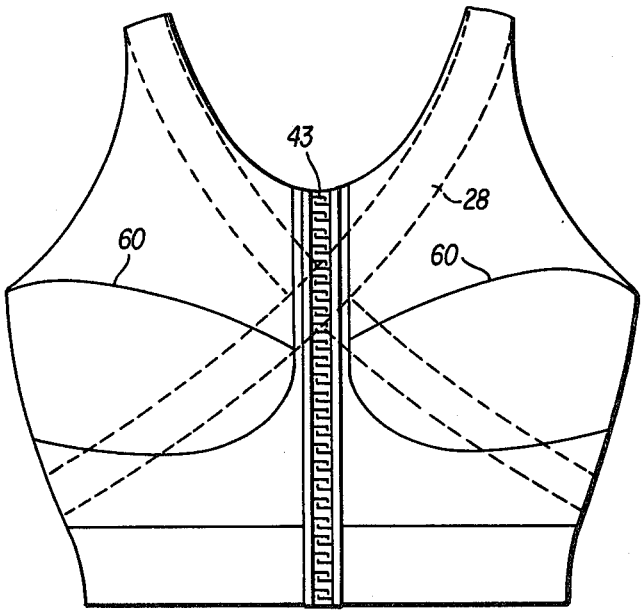
FIG. 9 is a front view of a brassiere utilizing a zipper.

Referring now specifically to FIGS. 3, 6 and 7, it can be seen that the front panels 23—23 are divided into two main portions: an elasticized portion 23*a* and a cup portion 23*b*. The cup portion 23*b* is not elastic and is preferably lined. It may have a decorative outer fabric and a plain cotton lining. The elastic portion 23*a* is preferably of a net construction so that air can pass therethrough reducing accumulation of heat and perspiration. Note that the elastic portion 23*a* extends along beneath the cup 23*b* and between the cup and the edge 32 of the front panel 23. Along the edge 32 of the front panel 23 there is positioned one-half of a fastening device, designated generally by the numeral 40. The fastening device may be a hook and eye arrangement 41*a*–41*b*, such as that shown in FIGS. 6 and 7, or may in the alternative be a VELCRO arrangement 42 such as that shown in FIG. 8, or a zipper arrangement 43 such as is shown in FIG. 9. In each case, with perhaps the single exception of VELCRO which already has a backing to keep the closure 40 isolated from the skin, a strip 45 (see FIG. 6) fits behind the closure. For example, in FIG. 6 the strip 45 is positioned behind the eyes 41*a* so that when the edges 32 are fastened together, neither the hooks 41*b* nor the hook eyes touch the woman's skin when the edges 32 are fastened together by the closure 40.

Since the panel 23 is elastic, it is necessary to configure the seams so that the bra will hold its shape when fastened. Accordingly, a seam 47 formed by sewing each panel 23*a* to the fastener 40 is inelastic, as are the seams along upper edges 29 and the seam 48 attaching the cups 23*b* to the panels. This inelasticity is due to the inelasticity of the material which is used to make the cup 23*b* and the inelasticity of the material used as a backing for the closure 40. The remaining seams, such as the bottom seam 50 and the seam 51 connecting the elastic area 23*a* to the elastic panel 26 are elastic. The top edge 31 of the panel 26 has an elastic reinforcing band 55 sewn thereto which extends up to the juncture 56 between the elastic straps 28 and the cup 23*b*. The elasticity of the band 55 is effectively terminated along the portion 55*a* which is sewn to the top edge of the cup because the cup material is not elastic and does not stretch.

As is readily seen from the back view of FIG. 7 and as is shown in cross section in FIG. 3 and in phantom in FIG. 6, one or both cups 23*b* have a non-elastic cotton panel 60 stitched thereto. The panel 60 forms a pocket with the back surface 61 of the cup 23*b*. Each pocket 60 receives a prosthesis 21, such as the prothesis shown in FIGS. 2, 4 and 5. As can be seen in FIGS. 6 and 7, the pocket formed by panel 60 is considerably below the top edge 29 of the front panel 23. In accordance with one preferred embodiment, this distance is approximately 4 inches measured from the top of the pocket 60 along the seam 63 extending from the top of the pocket to the edge 29 (see FIG. 7). In accordance with one example of the invention, the distance between the bottom of the bra and the top of the pocket 60 defined along line 64 is about 4 and ¾ inches and the distance between the bottom edge of the bra (along seam 50) and top edge 31 is 4 inches when taken a distance 1½ inches to the rear of line 64. Consequently, the edge 29 is made high with respect to the prosthesis 21 in the pocket 60, while the top edge 31 slopes off quickly and is relatively low with respect to the prosthesis at the point where the panel 26 passes beneath the wearer's arm.

Figure 2:
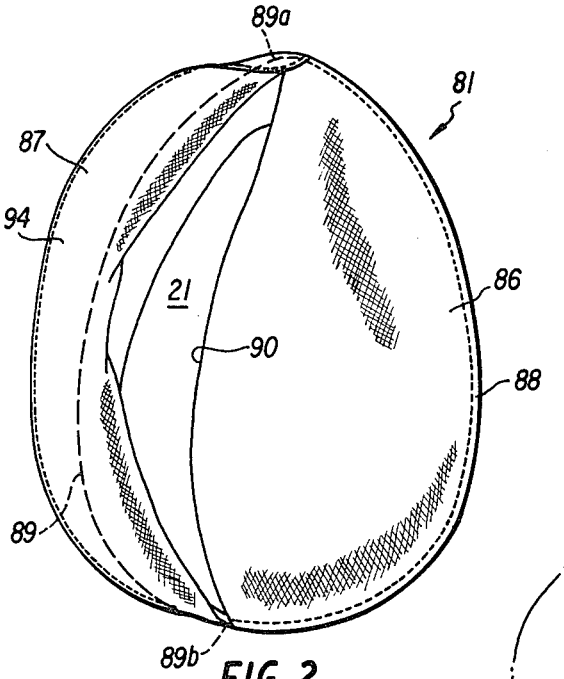
FIG. 2 is a perspective view of a cover in accordance with the instant invention used with a prosthesis which may be utilized in the bra of FIG. 1.
Figure 2A:
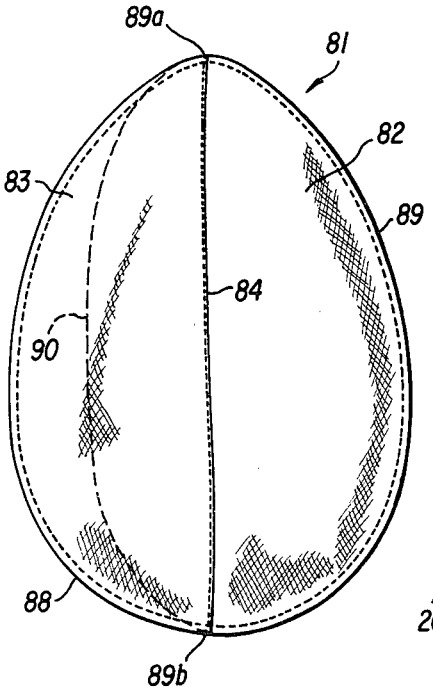
Figure 4:
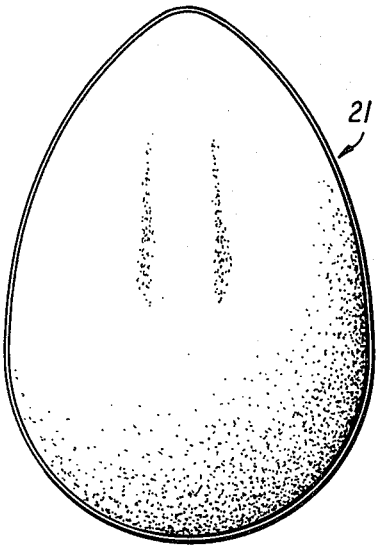
FIG. 4 is a front view of the prosthesis.
Figure 5:
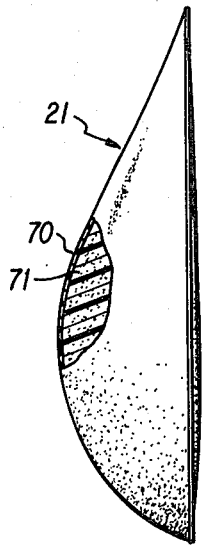
FIG. 5 is a side view (with a portion cut away of the prosthesis).

Referring now to FIG. 2, there is shown a prosthesis cover which is used to contain the prosthesis 21 shown in FIGS. 4 and 5. The prosthesis 21 generally will include a rubber or synthetic rubber sack 70 which is sealed and filled with a silicon gell 71 in accordance with well known techniques. The exterior surface of the sack 70 does not "breathe" and can be quite irritating to the wearer's bare skin causing localized perspiration, and from time to time, a rash. Moreover, the outer surface of the prosthesis sack 70 generally has a single color which is usually beige and does not necessarily match the skin tone of the person using the prosthesis. This, of course, can limit one's choice of clothes to clothes made of opaque materials.

In order to solve this problem, the prosthesis 21 is contained within a cover 81, which is preferably made of cotton and completely surrounds the prosthesis. The cover 81 is inexpensive to manufacture and if necessary can be dyed to match the skin tone of the woman wearing the prosthesis. In accordance with the preferred embodiment, the cover 81 includes a pair of front panels 82 and 83 which are generally in the shape of elongated ovals before being sewn together. In order to have a pucker or convex shape, the panels are sewn along the seam 84. As is seen in the drawings, the cover has a generally oval periphery. The rear portion of the sack 81 is also made of first and second elongated, generally oval, flaps or panels 86 and 87. The panel 86 is stitched to the bottom front panel 83 along line 88 which forms about one-half of the oval periphery while the panel 87 is stitched to the top front panel 82 along line 89 which forms the other half of the oval periphery. The panel 86 also has a small portion which is stitched to the top front panel 82 along lines 89*a* and 89*b* so that the free edge 90 of panel 86 extends above seam 83. Prosthesis 21 is contained within a pocket formed between the rear panel 86 and front panels 83 and 82.

In order to completely enclose the prosthesis 21, the rear panel 87 has a rear flap portion 94 which overlies the panel 86. In order to facilitate insertion of the prosthesis 21, the flap 94 is stitched to the front panel 82 only to the seam 84 on one side and considerably above the seam 84 on the other side.

Figure 10:
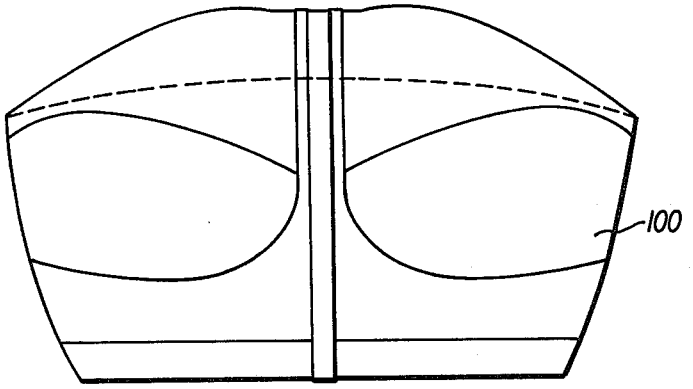
FIG. 10 is a front view of a strapless brassiere designed in accordance with the principles of the instant invention.
Figure 11:
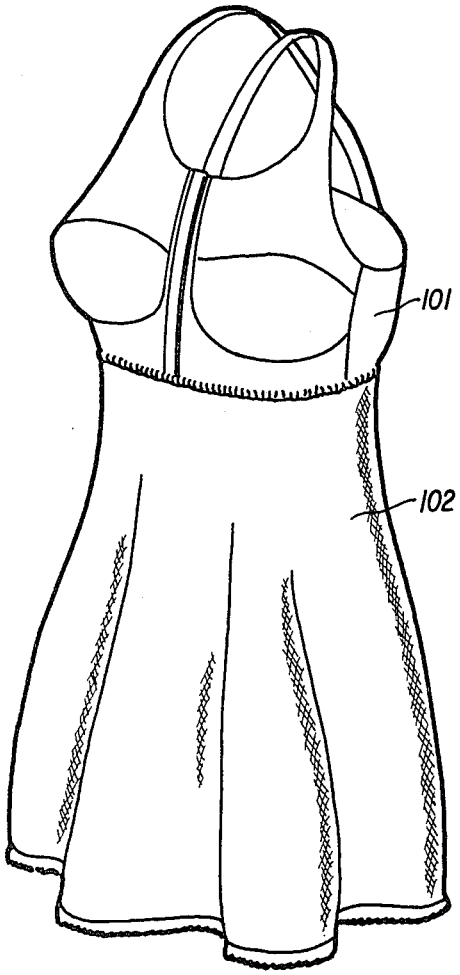
FIG. 11 is a perspective view of the brassiere in accordance with the instant invention in combination with a slip.
Figure 12:
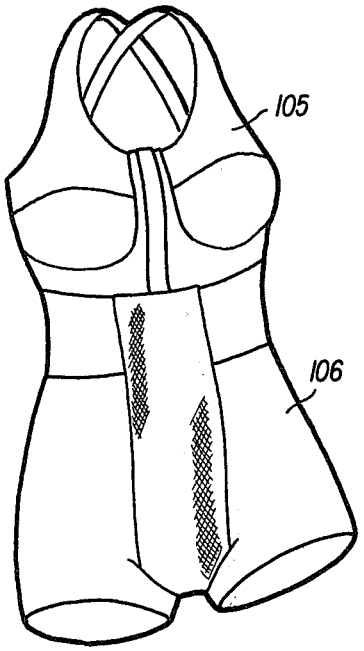
FIG. 12 is a front view of the brassiere in accordance with the instant invention utilized in combination with a girdle.

The aforedescribed configuration for the bra 20 can be used for several other arrangements such as those shown in FIGS. 10, 11 and 12. In FIG. 10, a strapless bra 100 is shown which can be worn with strapless bathing suits and other strapless garments of various types so that women can comfortably wear a prosthesis with these garments. FIG. 11 shows a brassier 101 of the aforementioned type in combination with a slip 102, while FIG. 12 shows a brassier 105 of the aforementioned type in combination with a girdle 106. In the embodiments of FIGS. 10, 11 and 12, brassiers are cut high in the front and low under the arms. Moreover, these brassiers include no metal fasteners or clips on a surface which might engage the skin and cause irritation. The brassiers 100, 101 and 105 are fastened in the front by the usual fastening devices such as the hook and eye arrangement 41 of FIG. 6, VELCRO 42 as shown in FIG. 8, or a conventional zipper 43 as shown in FIG. 9. In each case, there is a flap such as the flap 45 shown in FIG. 6 disposed between the fastener and the woman's skin.

The foregoing embodiments and examples are merely illustrative of the invention, which is limited only by the following claims.

FIG. 8 also shows bra with the instant invention configured as a mid-line bra for comfort and cosmetic features.

FIG. 9 shows the bra of the instant invention as a long-line bra and being cosmetically pleasing.

What is claimed is:

1. A brassier for supporting a prosthesis on a woman after she has had breast surgery; the brassier comprising in combination:

a pair of front panels each having a bottom seam, a top seam and a free edge with a seam thereon forming the top and bottom seams wherein the top seam is spaced from the bottom seam by a distance sufficiently great for the front panel to overlie surgical scars high on the chest of the woman wearing the brassiere by extending substantially straight across the woman's chest substantially above the natural cleavage line;

back panel means, contiguous with the front panels, for connecting the front panels together and for extending under the arms and around the back of the woman wearing the brassiere; said back panel means being continuous and having a top and bottom seam, the top seam converging steeply toward the bottom seam whereby the back panel means is cut low with respect to the woman's arms to avoid any surgical incisions under the woman's arms;

cup means in each front panel for supporting either one of the woman's breasts or a prosthesis;

pocket means behind at least one of the cup means for containing a prosthesis, said pocket means being positioned substantially lower than the point at which the top seam joins the free edge of the front panel wherein the front panel is cut to fit with the top seam relatively high on the woman's chest relative to the pocket to cover any surgical scars on the woman's chest, fastening means disposed adjacent to the free edges of the front panels for connecting the edges together whereby the brassiere fastens in the front, and a flesh-toned, cotton cover for the prosthesis, the cover having a convex front surface and a pair of overlapping back flaps providing a closure through which the prosthesis is easily inserted and removed, the cover being used when wearing the prosthesis to prevent contact between the prosthesis and the woman's skin.

2. The brassiere of claim 1 wherein the front panel and back panel are made of an elastic material and wherein the cup is made of an inelastic material.

3. The brassiere of claim 2 wherein the pocket is made of an inelastic material.

4. The brassiere of claim 3 wherein the top and bottom seams of the back panel means and the bottom seams of the front panel means are elastic and wherein the seam along the free edges of the front panel is inelastic.

5. The brassiere of claim 1, 2, 3 or 4 further including shoulder strap means attached to the back panel means and front panels, and being continuous therewith.

6. The brassiere of claims 1, 2, 3 or 4 wherein the brassiere is in combination with a slip.

7. The brassiere of claims 1, 2, 3 or 4 wherein the brassiere is in combination with a girdle.

8. The brassiere of claims 1, 2, 3 or 4 wherein the brassiere is strapless.

9. A cover for enclosing a silicone rubber breast prosthesis while the prosthesis is being worn in a prosthesis-supporting brassiere, the cover comprising:

cotton material for absorbing perspiration;

a convex front portion having a generally oval periphery;

a first rear flap having an edge portion stitched to the oval periphery around slightly more than one-half of the oval periphery and having a free end portion extending across the cover and behind the convex front portion;

a second rear flap stitched around the remaining half of the oval periphery and slightly over the first rear flap at the periphery, said second rear flap having a free edge portion which overlies the first rear flap and extends across the cover behind the first rear flap, whereby the prosthesis is enclosed within the cover by being inserted between the free end portions of the first and second rear flaps.

* * * * *